US007975489B2

(12) United States Patent
Joshi et al.

(10) Patent No.: US 7,975,489 B2
(45) Date of Patent: Jul. 12, 2011

(54) CATALYST MODULE OVERHEATING DETECTION AND METHODS OF RESPONSE

(75) Inventors: Ajay Joshi, Gilbert, AZ (US); David Yee, Hayward, CA (US)

(73) Assignee: Kawasaki Jukogyo Kabushiki Kaisha, Kobe-Shi, Hyogo (JP)

( * ) Notice: Subject to any disclaimer, the term of this patent is extended or adjusted under 35 U.S.C. 154(b) by 1282 days.

(21) Appl. No.: 10/571,798

(22) PCT Filed: Sep. 1, 2004

(86) PCT No.: PCT/US2004/028596
§ 371 (c)(1),
(2), (4) Date: Aug. 15, 2006

(87) PCT Pub. No.: WO2005/026675
PCT Pub. Date: Mar. 24, 2005

(65) Prior Publication Data

US 2007/0028625 A1 Feb. 8, 2007

Related U.S. Application Data

(60) Provisional application No. 60/500,449, filed on Sep. 5, 2003.

(51) Int. Cl.
*F02C 1/00* (2006.01)
*F02C 7/22* (2006.01)

(52) U.S. Cl. ..... 60/777; 60/723

(58) Field of Classification Search ..... 60/777, 60/723, 238, 240, 243, 790, 39.281, 800, 60/734; 431/7, 170
See application file for complete search history.

(56) References Cited

U.S. PATENT DOCUMENTS

| | | | |
|---|---|---|---|
| 3,846,979 | A | 11/1974 | Pfefferle |
| 3,928,961 | A | 12/1975 | Pfefferle |
| 3,975,900 | A | 8/1976 | Pfefferle |
| 4,473,536 | A | 9/1984 | Carberg et al. |
| 4,534,165 | A | 8/1985 | Davis, Jr. et al. |
| 4,726,181 | A | 2/1988 | Pillsbury |
| 4,794,753 | A | 1/1989 | Beebe |

(Continued)

FOREIGN PATENT DOCUMENTS

EP 0 453 178 A1 10/1991

(Continued)

OTHER PUBLICATIONS

Felder, R.M. et al. (1978). "Adiabatic Flame Temperature," Chapter 10, Section 10.6b. *In Elementary Principles of Chemical Processes*, John Wiley & Sons, Inc.: New York, NY, pp. xi-xiv, (Table of Contents), p. 414.

(Continued)

*Primary Examiner* — Michael Cuff
*Assistant Examiner* — Gerald L Sung
(74) *Attorney, Agent, or Firm* — Locke Lord Bissell & Liddell LLP

(57) ABSTRACT

According to one aspect, a method of detecting catalyst module overheating in a catalytic combustion system is provided. In one example, the method includes detecting one or more signals from at least one probe adapted to obtain values associated with at least one of the outlet gas temperature of a catalyst module and the outlet face temperature of the catalyst module included in a catalytic combustor. The one or more signals are compared with a preselected value associated with catalyst overheating. The detected temperature may be detected over time to determine a rate of change in the temperature. The temperature may be detected with a UV sensor directed to the catalyst outlet face.

13 Claims, 6 Drawing Sheets

U.S. PATENT DOCUMENTS

| | | | |
|---|---|---|---|
| 5,133,180 | A | 7/1992 | Horner et al. |
| 5,139,755 | A | 8/1992 | Seeker et al. |
| 5,152,685 | A | 10/1992 | Coulon |
| 5,161,366 | A | 11/1992 | Beebe |
| 5,165,224 | A | 11/1992 | Spadaccini et al. |
| 5,183,401 | A | 2/1993 | Dalla Betta et al. |
| 5,232,357 | A | 8/1993 | Dalla Betta et al. |
| 5,235,804 | A | 8/1993 | Colket, III et al. |
| 5,248,251 | A | 9/1993 | Dalla Betta et al. |
| 5,250,489 | A | 10/1993 | Dalla Betta et al. |
| 5,258,349 | A | 11/1993 | Dalla Betta et al. |
| 5,259,754 | A | 11/1993 | Dalla Betta et al. |
| 5,263,325 | A | 11/1993 | McVey et al. |
| 5,269,679 | A | 12/1993 | Syska et al. |
| 5,281,128 | A | 1/1994 | Dalla Betta et al. |
| 5,318,436 | A | 6/1994 | Colket, III et al. |
| 5,326,253 | A | 7/1994 | Dalla Betta et al. |
| 5,395,235 | A | 3/1995 | Lan-Sun Hung |
| 5,405,260 | A | 4/1995 | Dalla Betta et al. |
| 5,413,477 | A | 5/1995 | Moreland |
| 5,421,719 | A | 6/1995 | Saito et al. |
| 5,425,632 | A | 6/1995 | Tsurumi et al. |
| 5,452,574 | A | 9/1995 | Cowell et al. |
| 5,461,855 | A | 10/1995 | Inoue et al. |
| 5,461,864 | A | 10/1995 | Betta et al. |
| 5,474,441 | A | 12/1995 | Farrauto et al. |
| 5,511,972 | A | 4/1996 | Dalla Betta et al. |
| 5,512,250 | A | 4/1996 | Betta et al. |
| 5,518,697 | A | 5/1996 | Dalla Betta et al. |
| 5,551,869 | A | 9/1996 | Brais et al. |
| 5,554,021 | A | 9/1996 | Robertson et al. |
| 5,569,020 | A | 10/1996 | Griffin et al. |
| 5,581,997 | A | 12/1996 | Janes |
| 5,634,784 | A | 6/1997 | Pfefferle et al. |
| 5,720,163 | A | 2/1998 | Pfefferle et al. |
| 5,729,967 | A | 3/1998 | Joos et al. |
| 5,797,737 | A | 8/1998 | Le Gal et al. |
| 5,826,429 | A | 10/1998 | Beebe et al. |
| 5,837,205 | A | 11/1998 | Bayer et al. |
| 5,850,731 | A | 12/1998 | Beebe et al. |
| 5,879,148 | A | 3/1999 | Cheng et al. |
| 5,896,738 | A | 4/1999 | Yang et al. |
| 5,913,675 | A | 6/1999 | Vago et al. |
| 5,937,632 | A | 8/1999 | Döbbeling et al. |
| 5,937,634 | A | 8/1999 | Etheridge et al. |
| 5,957,682 | A | 9/1999 | Kamal et al. |
| 5,965,001 | A | 10/1999 | Chow et al. |
| 5,985,222 | A | 11/1999 | Sudduth et al. |
| 6,000,212 | A | 12/1999 | Kolaczkowski et al. |
| 6,038,861 | A | 3/2000 | Amos et al. |
| 6,066,303 | A | 5/2000 | Sudduth et al. |
| 6,082,111 | A | 7/2000 | Stokes |
| 6,089,855 | A | 7/2000 | Becker et al. |
| 6,094,916 | A | 8/2000 | Puri et al. |
| 6,095,793 | A | 8/2000 | Greeb |
| 6,105,360 | A | 8/2000 | Willis |
| 6,109,018 | A | 8/2000 | Rostrup-Nielsen et al. |
| 6,116,014 | A | 9/2000 | Dalla Betta et al. |
| 6,122,916 | A | 9/2000 | Amos et al. |
| 6,125,625 | A | 10/2000 | Lipinski et al. |
| 6,128,894 | A | 10/2000 | Joos et al. |
| 6,201,029 | B1 | 3/2001 | Waycuilis |
| 6,217,832 | B1 | 4/2001 | Betta et al. |
| 6,226,977 | B1 | 5/2001 | Ichiryu et al. |
| 6,237,343 | B1 | 5/2001 | Butler |
| 6,250,877 | B1 | 6/2001 | Westphal et al. |
| 6,257,869 | B1 | 7/2001 | Martin et al. |
| 6,270,336 | B1 | 8/2001 | Terashima et al. |
| 6,280,695 | B1 | 8/2001 | Lissianski et al. |
| 6,286,482 | B1 | 9/2001 | Flynn et al. |
| 6,289,667 | B1 | 9/2001 | Kolaczkowski et al. |
| 6,298,654 | B1 | 10/2001 | Vermes et al. |
| 6,339,925 | B1 | 1/2002 | Hung et al. |
| 6,425,754 | B1 | 7/2002 | Lindskog |
| 6,595,003 | B2 | 7/2003 | Dalla Betta et al. |
| 6,796,129 | B2 | 9/2004 | Yee et al. |
| 2001/0046650 | A1 | 11/2001 | Smith et al. |
| 2002/0056276 | A1 | 5/2002 | Dalla Betta et al. |
| 2002/0083715 | A1 | 7/2002 | Dalla Betta et al. |
| 2004/0206091 | A1 | 10/2004 | Yee et al. |

FOREIGN PATENT DOCUMENTS

| | | | |
|---|---|---|---|
| EP | 0 453 178 | B1 | 10/1991 |
| JP | 63-163716 | A | 7/1988 |
| WO | WO-03/021150 | A2 | 3/2003 |
| WO | WO-03/021150 | A3 | 3/2003 |
| WO | WO-03/021150 | C2 | 3/2003 |
| WO | WO-2004/065777 | A2 | 8/2004 |
| WO | WO-2004/065777 | A3 | 8/2004 |
| WO | WO-2005/026675 | A2 | 3/2005 |
| WO | WO-2005/026675 | A3 | 3/2005 |

OTHER PUBLICATIONS

International Search Report mailed on Feb. 24, 2005, for PCT Application No. PCT/US04/01238 filed Jan. 15, 2004, 4 pages.

International Search Report mailed on Apr. 6, 2005, for PCT Application No. PCT/US04/28596 filed Sep. 1, 2004, 4 pages.

Lefebvre, A. H. (1998). *Gas Turbine Combustion*, Hemisphere Publishing Corporation, pp. v-xiv. (Table of Contents), p. 48 (Fig. 2.7), p. 49, and p. 192 (Fig. 6.13).

Vatcha, S. R. (1997). "Low-Emission Gas Turbines Using Catalytic Combustion," *Energy Conversion and Management* 38(10-13):1327-1334.

CATALYST MODULE OVERHEATING DETECTION AND METHODS OF RESPONSE

BACKGROUND

1. Field of the Invention

The invention relates generally to catalytic combustion systems and control methods, and more particularly to systems and methods for detecting and responding to catalyst module overheating or conditions that may result in a catalyst module overheating in single or multi-combustor processes as they relate to and are utilized by catalytic gas turbine engines.

2. Description of the Related Art

In a conventional gas turbine engine, the engine is controlled by monitoring the speed of the engine and adding a proper amount of fuel to control the engine speed. Specifically, should the engine speed decrease, fuel flow is increased causing the engine speed to increase. Similarly, should the engine speed increase, fuel flow is decreased causing the engine speed to decrease. In this case, the engine speed is the control variable or process variable monitored for control. A similar engine control strategy is used when the gas turbine is connected to an AC electrical grid in which the engine speed is held constant as a result of the coupling of the generator to the grid frequency. In such a case, the total fuel flow to the engine may be controlled to provide a given power output level or to run to maximum power with such control based on controlling exhaust gas temperature or turbine inlet temperature. Again, as the control variable rises above a set point, the fuel is decreased. Alternatively, as the control variable drops below the set point, the fuel flow is increased. This control strategy is essentially a feedback control strategy with the fuel control valve varied based on the value of a control or process variable compared to a set point.

In a typical non-catalytic combustion system using a diffusion flame burner or a simple lean premixed burner, the combustor has only one fuel injector. In such systems, a single valve is typically used to control the fuel flow to the engine. In more recent lean premix systems however, there may be two or more fuel flows to different parts of the combustor, with such a system thus having two or more control valves. In such systems, closed loop control may be based on controlling the total fuel flow based on the required power output of the gas turbine while fixed (pre-calculated) percentages of fuel flow are diverted to the various parts of the combustor. The total fuel flow will change over time. In addition, the desired fuel split percentages between the various fuel pathways (leading to various parts of the combustor) may either be a function of certain input variables or they may be based on a calculation algorithm using process inputs such as temperatures, airflow, pressures, and the like. Such control systems offer ease of control due primarily to the very wide operating ranges of these conventional combustors and the ability of the turbine to withstand short spikes of high temperature without damage to various turbine components. Moreover, the fuel/air ratio fed to these combustors may advantageously vary over a wide range with the combustor remaining operational.

A properly operated catalyst combustion system may provide significantly reduced emission levels, particularly NOx. Unfortunately, however, such systems generally have a narrower operating range than conventional diffusion flame or lean premix combustors. For example, operation of catalytic combustors above desired temperature limits, which may vary depending on the particular application and design of each combustor system, may result in thermal damage to the catalytic module. Such operation could be a result of a variety of contributing factors in single or multi-combustor applications, including variations in fuel composition outside of specifications, blockage of catalytic channels caused by foreign objects, lack of uniformity of inlet fuel-air mixture, flameholding in the burn-out-zone radiating heat back to the catalyst, or lack of uniformity of catalytic material on the substrate due to manufacturing variability. In multi-combustor specific applications discussed below, operation above desired temperature limits may be a result of combustor-to-combustor non-uniformities.

The configuration of industrial gas turbines with conventional, non-catalytic combustors, varies from simple single-silo configurations, i.e., one combustor as discussed above, to multiple-combustor configurations. The application of industrial, or otherwise, gas turbine engines with catalytic combustion, however, has been limited to the single-silo configuration. For example, the Kawasaki Heavy Industries M1A-13X and the GE 10 (PGT 10B) gas turbine engines.

The application of catalytic combustion in a multi-combustor configuration poses several additional problems that may lead to thermal damage to one or more catalyst modules. For example, in a multi-combustor configuration there typically are variations from combustor-to-combustor due to manufacturing or design differences that may lead to variations in pre-burner ignition, catalyst light-off, and/or homogeneous combustion in the burnout zone across the multiple combustors. Additionally, the combustor sizes are typically reduced to prevent combustor-to-combustor physical interference adding complexity to the design of the combustors. Combustor size reduction can be achieved through flameholders in the burn-out zone and single-stage catalyst designs. To supplement the single stage catalyst designs, pre-burners with wide turn-down ratios are generally used. These design changes will require more complex control of the pre-burner, catalyst fuel/air ratio, and/or post catalyst homogenous combustion burnout zone to ensure the combustion system operates within its operating window.

What is needed therefore is a method and system for detecting catalyst module overheating or conditions that may result in catalyst module overheating in single and multi-combustor systems. Additionally, methods of controlling catalytic combustion systems including single and multiple combustors in response to catalyst module overheating is needed. Finally, a method and system are needed that reduce the potential for overshooting and exceeding desired temperature limits for the catalyst module during transient operations, such as load ramps and the like.

BRIEF SUMMARY OF THE INVENTION

According to one aspect of the present invention, a method of detecting catalyst module overheating in a catalytic combustion system is provided. In one example, the method includes detecting one or more signals from at least one temperature probe adapted to measure at least one of an outlet gas temperature of the catalyst module and an outlet face temperature of the catalyst module included in a catalytic combustor, or detecting the homogeneous combustion wave location relative to the catalyst module. The temperature is compared with a value associated with catalyst overheating. The homogeneous combustion wave location is compared to a preselected value associated with catalyst overheating. The detected temperature and/or wave location may be detected over time to determine a rate of change in the temperature and/or wave location. The temperature may be detected with a thermocouple at the catalyst exit face or an Infrared (IR) thermal sensor directed to the catalyst exit face. The combustion wave location may be detected with a UV sensor directed toward the catalyst exit face and/or the region immediately downstream of the catalyst exit face. The combustion wave location may also be detected with metal and/or gas temperature sensors located axially along the burn out zone, or a hydrocarbon or CO sensor located in the flowpath downstream of the catalyst.

According to another aspect of the present invention, a method for controlling a catalytic combustion system is provided. In one example, the method includes detecting a temperature associated with a catalyst in a combustor exceeding a preselected temperature, and varying at least one of fuel flow and air flow to the catalyst and/or preburner to reduce the temperature.

The present invention is better understood upon consideration of the detailed description below in conjunction with the accompanying drawings and claims.

DETAILED DESCRIPTION OF THE INVENTION

The present invention provides various methods of operating catalytic combustion systems including detecting, responding to, and preventing catalyst overheating. The following description is presented to enable any person skilled in the art to make and use the invention. Descriptions of specific structures, functions, techniques, and applications are provided only as examples. Various modifications to the examples described herein will be readily apparent to those skilled in the art, and the general principles defined herein may be applied to other examples and applications without departing from the spirit and scope of the invention. Thus, the present invention is not intended to be limited to the examples described and shown, but is to be accorded the scope consistent with the appended claims.

Exemplary methods and systems are described herein for improved control strategies and efficient application of single or multi-combustor catalytic combustion system or mixed (i.e., catalytic combustion and non-catalytic combustion) configurations for gas turbine engines. Various methods and systems described herein address issues associated with detecting and reacting to actual overheating or potential overheating of the catalyst module in a combustor system. Further, methods and systems are described for reducing the potential of temperature overshoots of the catalyst exit gas temperature in a catalytic combustion system during transient operation of the system, e.g., during load ramp sequences and the like.

Figure 1:
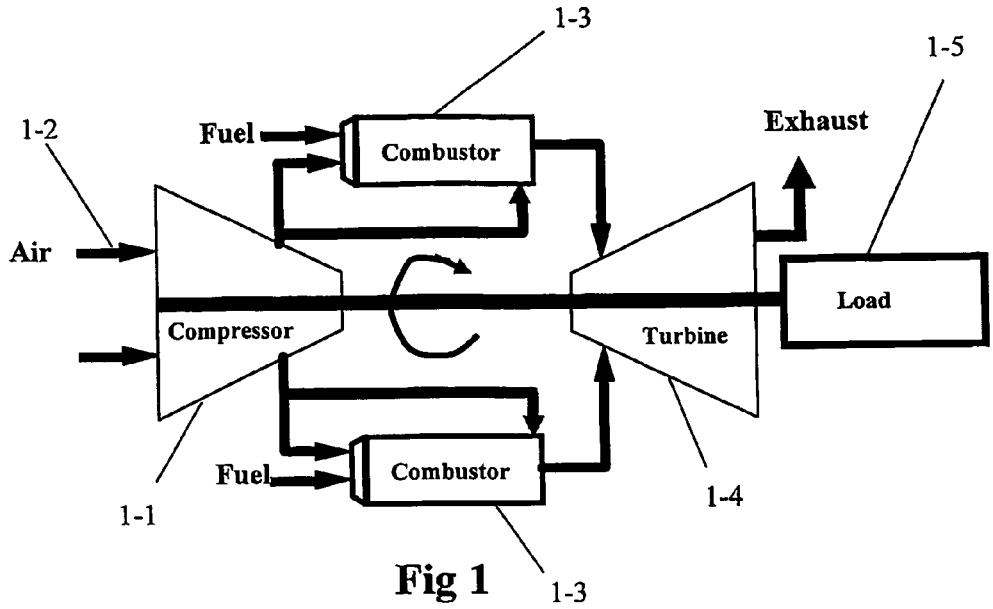
FIG. 1 illustrates an exemplary gas turbine system.

Exemplary Catalytic Combustion Systems:

FIG. 1 schematically illustrates an exemplary catalytic combustor gas turbine system including one or more catalytic combustors 1-3 that may be employed with various methods and systems described herein. Compressor 1-1 ingests ambient air 1-2 through a compressor bellmouth, and compresses the air to a higher pressure driving the compressed air, at least in part, through one or more combustors 1-3 and through the drive turbine 14. Each combustor 1-3 mixes fuel and air 1-2 and combusts the mixture to form a hot, high velocity gas stream that flows through the turbine 14. The high velocity gas stream provides power to drive turbine 14 and the load 1-5. Load 1-5 may be, for example, a generator or the like. Although a multi-combustor gas turbine system is illustrated, it should be understood that the present exemplary methods and systems are applicable to single or multi-combustor gas turbine systems.

Figure 2:
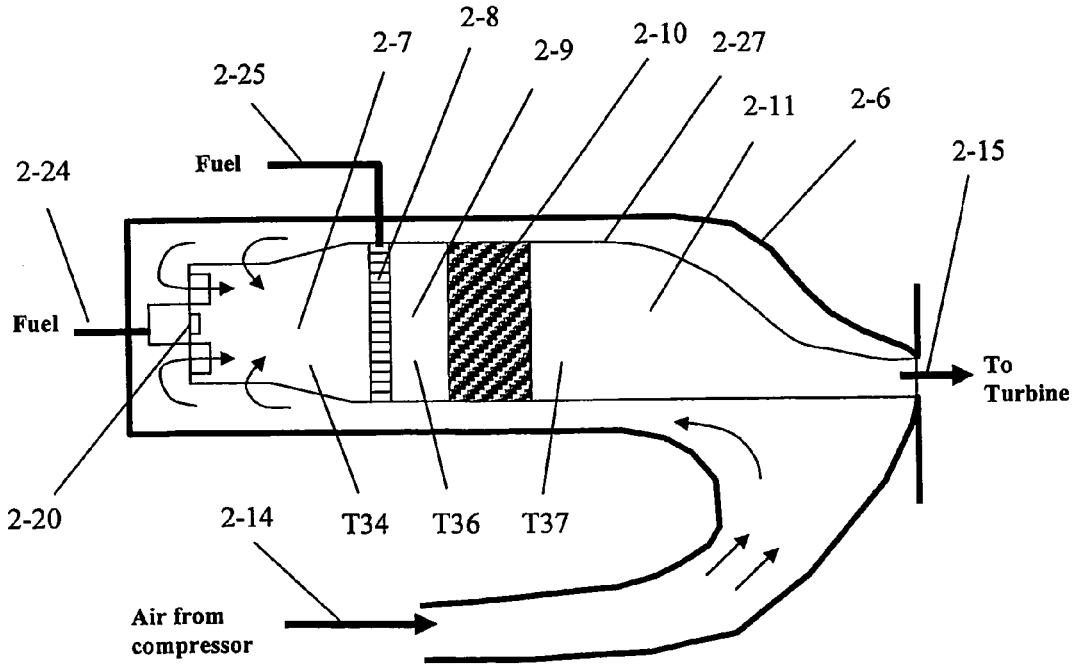
FIG. 2 illustrates an exemplary catalytic combustion system.

FIG. 2 is a more detailed illustrated of a single combustor 2-6 that may be included alone or as part of the multiple combustor configuration of FIG. 1. Catalytic combustor 2-6 generally includes three major elements that are arrayed serially in the flow path of at least a portion of the air from the compressor discharge 2-14. Specifically, these three elements include a fuel injection and mixing system 2-8, a catalyst 2-10, and a burnout zone 2-11. Additionally, a preburner 2-20, for example, a flame preburner (which is positioned upstream of the catalyst and which produces a hot gas mixture 2-7) may be included. The hot gases exiting from the combustion system flow into the drive turbine 2-15 to produce power that may drive a load. In preferred aspects, there are two independently controlled fuel streams, with one stream 2-24 directed to a preburner 2-20 and the other stream 2-25 being directed to the catalyst fuel injection and mixing system 2-8, as shown. Further, in some examples multiple preburner zones or fuel stages may be employed with additional independently controlled fuel streams for each fuel stage of preburner 2-20.

In one example, catalytic combustor 2-6 may generally operate in the following manner. The majority of the air from the gas turbine compressor discharge 2-14 flows through the preburner 2-20 and catalyst 2-10. Preburner 2-20 functions to help start up the gas turbine and to adjust the temperature of the air and fuel mixture prior to the catalyst 2-10 in region 2-9. For instance, preburner 2-20 heats the air and fuel mixture to a level that will support catalytic combustion of the main fuel stream 2-25, which is injected and mixed with the flame burner discharge gases (by catalyst fuel injection and mixing system 2-25) prior to entering catalyst 2-10. Preburner 2-20 may further be used to adjust the catalyst 2-10 inlet temperature by varying, for example, the fuel or air supply to the preburner 2-20. Ignition of each combustor 2-6 in a multi-combustor system may be achieved by means of a spark plug or the like in conjunction with cross fire tubes (not shown) linking the various combustors 2-6 as is known in the art. Additionally, a catalytic preburner receiving inlet air heated electrically or via a smaller start-up pilot burner may be included.

Partial combustion of the fuel/air mixture occurs in catalyst 2-10, with the balance of the combustion occurring in the burnout zone 2-11, located downstream of the exit face of catalyst 2-10. Typically, 10%-90% of the fuel is combusted in catalyst 2-10. Preferably, to fit the general requirements of the gas turbine operating cycle including achieving low emissions, while obtaining good catalyst durability, 20%-70% of the fuel is combusted in catalyst 2-10, and most preferably between about 30% to about 60% is combusted in catalyst 2-10. In various aspects, catalyst 2-10 may include either a single stage (as shown) or a multiple stage catalyst including multiple catalysts 2-10 serially located within the combustor 2-6.

Reaction of any remaining fuel not combusted in the catalyst and the reaction of any remaining carbon monoxide to carbon dioxide occurs in burnout zone 2-11, thereby advantageously obtaining higher temperatures without subjecting the catalyst to these temperatures and obtaining very low levels of unburned hydrocarbons and carbon monoxide. After combustion has occurred in burnout zone 2-11, any cooling air or remaining compressor discharge air, e.g., from a bypass valve, may be introduced into the hot gas stream at 2-15, typically located just upstream of the turbine inlet. In addition, if desired, air can optionally be introduced through liner wall 2-27 at a location close to the turbine inlet 2-15 as a means to adjust the temperature profile to that desired for the turbine section at location 2-15. Such air introduction to adjust the temperature profile is one of the design parameters for power turbine 2-15. Another reason to introduce air through liner 2-27 in the region near the turbine 2-15 would be for turbines with very low inlet temperatures at 2-15. For example, some turbines require turbine inlet temperatures in the range of 900 to 1100° C., temperatures too low to completely combust the remaining unburned hydrocarbons and carbon monoxide within the residence time of the burnout zone 2-11. In these cases, a significant fraction of the air may be diverted through the liner 2-27 in the region near turbine 2-15. This allows for a higher temperature in region 2-11 for rapid and complete combustion of the remaining fuel and carbon monoxide.

Figure 3:
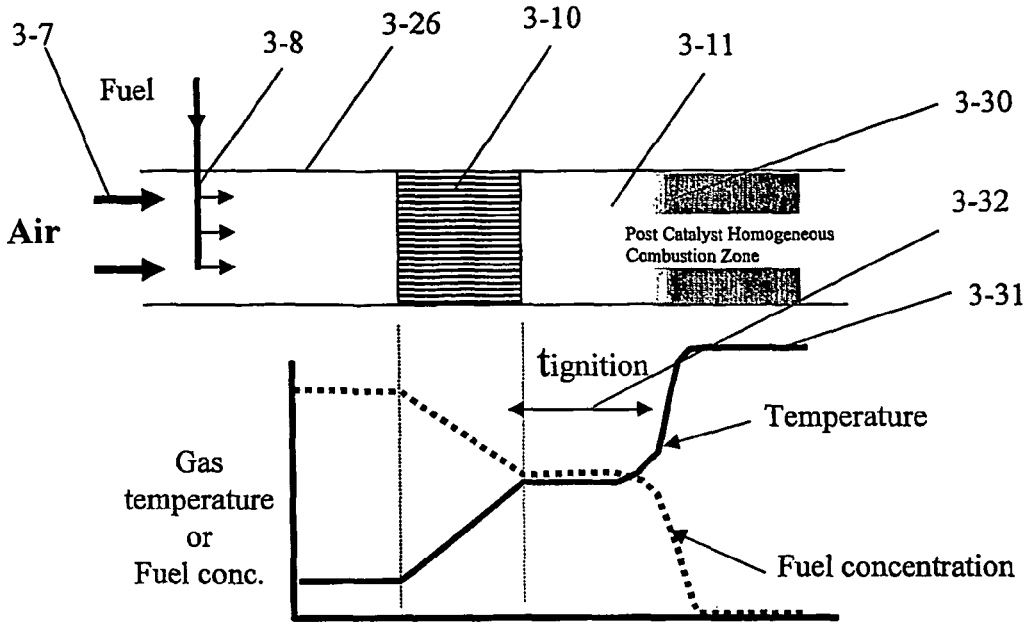
FIG. 3 illustrates an exemplary catalytic combustion system with associated temperature and fuel concentration profiles.

FIG. 3 illustrates an example of a typical existing partial combustion catalyst system and relative temperatures corresponding to a catalytic combustor system, e.g., as shown in FIGS. 1 and 2. In such systems, only a portion of the fuel is combusted within catalyst 3-10 and a significant portion of the fuel is combusted downstream of catalyst 3-10 in a post catalyst homogeneous combustion zone 3-11. Further examples of partial combustion catalyst systems and methods of operation are described in co-pending patent application and prior patents, for example: U.S. patent application Ser. Nos. 10/071,749 and 60/440,940 to D. Yee et al.; U.S. Pat. Nos. 5,183,401, 5,232,357, 5,250,489, 5,281,128, 5,326,253, 5,511,972, and 5,518,697 to Dalla Betta et al.; and U.S. Pat. No. 5,425,632 to Tsurumi et al., all of which are incorporated herein by reference in their entirety as if fully put forth herein.

FIG. 3 includes a linear schematic representation of a simplified partial combustion catalytic system illustrated with the gas temperature and fuel concentrations at various locations along the flow path shown there below. Air 3-7 enters combustor 3-26 and passes through a fuel injection and mixing system 3-8 that injects fuel into the flowing air stream. A portion of the fuel is combusted in the catalyst 3-10 resulting in an increase in temperature of the gas mixture as it passes through catalyst 3-10. As can be seen, the mixture exiting catalyst 3-10 is at an elevated temperature. This fuel/air mixture contains remaining unburned fuel that undergoes autoignition in the post catalyst burnout zone 3-11. The burnout zone 3-11 includes the portion of the flow path downstream of the catalyst but prior to introduction of additional air and before the turbine where the gas mixture exiting the catalyst may undergo further reaction. The fuel is combusted in the burnout zone 3-11 to form final reaction products including $CO_2$ and $H_2O$ with the temperature rising to the final combustion temperature 3-31 at homogeneous combustion wave 3-30 (the region where the remaining uncombusted fuel exiting the catalyst is combusted). The resulting hot, high-energy gases in burnout zone 3-11 may drive the power turbine and load (e.g., 1-4 and 1-5 in FIG. 1).

The lower portion of FIG. 3 illustrates a graph with the gas temperature indicated on the ordinate and the position along the combustor, or flow path through the combustor, indicated on the abscissa. The position of the graph corresponding generally to the linear combustor diagram directly above it. As can be seen, the gas temperature increases as the mixture passes through catalyst 3-10 and a portion of the mixture combusts. Downstream of catalyst 3-10, however, the mixture temperature is constant for a period, typically referred to as the ignition delay time 3-32, $T_{ignition}$, before the remaining fuel combusts to form the homogeneous combustion wave 3-30. The combustion of the mixture in the burnout zone 3-11 thereby further raises the gas temperature.

Homogeneous combustion in the burnout zone is primarily determined by the ignition delay time of the gas exiting the catalyst. The ignition delay time and catalyst exit conditions may be controlled such that the position of the homogeneous combustion wave can be moved and maintained at a preferred location within the post catalyst reaction zone. The location of the homogeneous combustion wave 3-30 may therefore be moved by changing, for example, the gas composition (i.e., fuel-to-air ratio), pressure, catalyst outlet temperature, and the adiabatic combustion temperature (i.e., the temperature of a fuel and air mixture after all of the fuel in the mixture has been combusted with no thermal energy lost to the surroundings). For example, by increasing the catalyst outlet temperature T37, the location of the homogeneous combustion wave moves closer to the catalyst 3-10, and decreasing the catalyst outlet temperature T37 moves the homogeneous combustion process farther downstream from the catalyst 3-10. In this way, an exemplary control system may advantageously keep catalyst operation for a single combustor or across multiple combustors within a preferred operating regime for good catalyst durability while maintaining low emissions. Specifically, when operating in such a preferred operating regime, emissions of NOx, CO, and unburned hydrocarbons may all be reduced while the durability of the catalysts may be maintained.

Preferably, the homogeneous combustion wave is located downstream of the catalyst but not so far downstream that a long reaction zone or volume is required of the combustor, and not too close to the catalyst module that may result in damage to the catalyst module from high temperatures. Ignition delay time depends, at least in part, on the gas composition, gas pressure within the combustor, total mass flow rate/velocity, catalyst outlet gas temperature T37, and adiabatic combustion temperature. These five parameters may be adjusted in real time by an exemplary control system to change the ignition delay within each combustor and compensate for variations from combustor-to-combustor across the system. For example, various operational methods and strategies are described in previously cited U.S. patent applications Ser. Nos. 10/071,749 and 60/440,940.

In accordance with the present invention, single or multi-combustor catalytic systems may be controlled to operate with the catalyst module in predetermined temperature ranges. Further, a multi-combustor system may be controlled to achieve uniform position of the homogeneous combustion wave from combustor-to-combustor as well as operate with similar or different temperature ranges across different catalyst modules. The position and temperature may be maintained within preferred ranges by operating the system based on a predetermined schedule, wherein a predetermined or calculated schedule is based, at least in part, on the operating conditions of the catalytic combustor and/or the catalyst performance. Schedules may be based on operating ranges generated from theoretically based models or actual tests of the combustors in subscale or full scale test systems. For example, predetermined operating schedules for single or multi-combustor systems are described in previously referenced U.S. patent application Ser. Nos. 10/071,749 and 60/440,940. It should be recognized by those skilled in the art that various other methods for determining a preferred operating range and schedule are possible.

Operation of the catalyst 2-10 above designed temperatures may cause material damage to the catalyst 2-10, reduced catalytic activity of catalyst module 2-10, increased emissions of the system, and the like. Temperatures may increase above desired temperatures for the catalyst 2-10 for a large number of factors in a single or multi-combustor application including variations in fuel composition outside of specification, blockage of catalytic channels in the catalyst 2-10 caused by foreign objects, lack of uniformity of inlet fuel-air mixture, flameholding in the burn-out zone 2-11, lack of uniformity of catalytic material on the substrate of catalyst 2-10, and the like. Further, in multicombustor applications, variations from combustor-to-combustor may cause temperatures to vary above desired ranges for individual combustors.

Control of the outlet gas temperature T37 of catalyst 2-10 (and the homogeneous combustion wave location) may be achieved by controlling the percentages (and, optionally, the total amount) of fuel sent to the preburner (e.g., fuel line 2-24 and preburner 2-20 of FIG. 2) and/or the catalyst fuel injection and mixing system (e.g., fuel line 2-25 and fuel injection system 2-8 of FIG. 2). For example, adding fuel to 2-24 burns more fuel in the preburner 2-20 and increases the temperature of the gas mixture at location 2-9, the catalyst inlet. This raises the temperature at the catalyst outlet temperature T37. Adding fuel at 2-8 changes the fuel-to-air ratio at 2-9 and also increases T37. Further, control of the catalyst outlet temperature T37 (and the position of the homogeneous combustion wave 3-30) may be achieved by controlling the airflow of the combustors with a bypass system, bleed valves, inlet guide vanes, and the like.

According to one aspect of the present invention, methods and systems are provided for detecting incidents preceding a potential or actual catalyst module overheating event, referred to herein as "catalyst module overheating," or simply "overheating." The various aspects are equally applicable to either single or multi-combustor applications. Further, systems and methods are described for responding to and reducing potential or actual catalyst module overheating temperatures. According to another aspect of the invention, control strategies are provided for reducing the likelihood of temperature overshoots during transient operations, such as load ramps and the like for single or multicombustor systems that may cause catalyst module overheating.

Figure 4A:
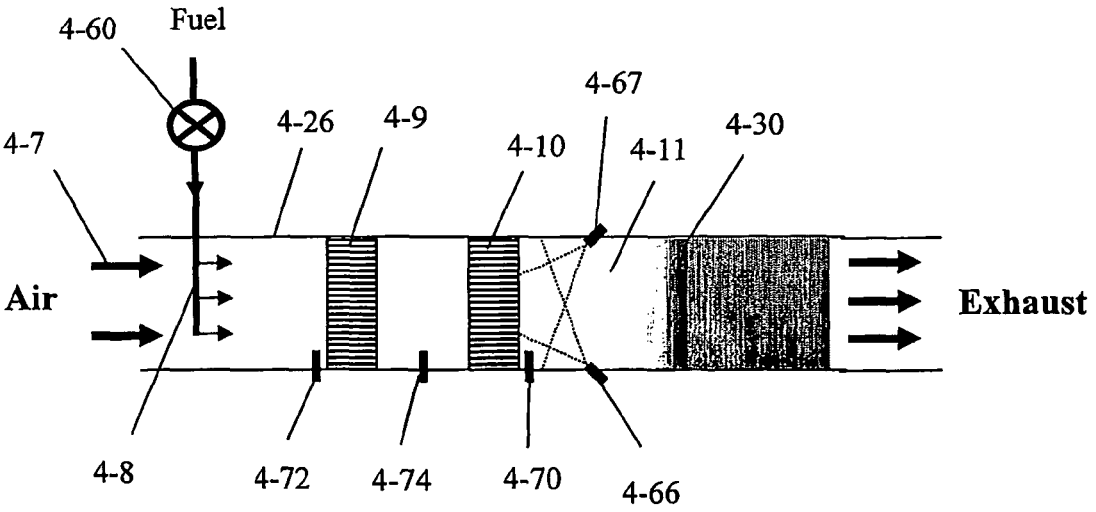
FIGS. 4A-4C illustrate exemplary catalytic combustion systems including various sensors configured for detecting catalyst module overheating conditions.

Catalyst Module Overheating Detection:

FIG. 4A illustrates an exemplary linear schematic representation of a combustor 4-26 including various sensors for detecting overheating of catalyst 4-10. FIG. 4A illustrates a two stage catalyst including stages 4-9 and 4-10. The exemplary system could also be employed with a single stage catalyst 4-10. In general, regardless of the number of serial stages, inlet thermocouples are disposed at 4-72, outlet thermocouples at 4-70, and interstage thermocouples (if applicable) at 4-74. As will be described in greater detail below, upon detection of overheating temperatures the system may decrease the temperature of catalyst 4-10. For example, the system may control and alter the catalyst fuel flow to combustor 4-26 via catalyst fuel valve 4-60 thereby influencing the temperature of catalyst 4-10. In particular, the fuel flow to the catalyst 4-10 through fuel valve 4-60 may be controlled, for example, by a feedback measurement of the catalyst inlet or catalyst 4-10 temperature thereby influencing the temperature of catalyst 4-10 and the position of the homogeneous combustion wave 4-30. Further, the airflow 4-7 may be varied and managed through bypass valves, bleed valves, inlet guide vanes, or the like to vary the temperature of catalyst 4-10.

In one exemplary system, a single ultra-violet (UV) sensor 4-66 is located in the homogeneous combustion burn-out zone 4-11 as illustrated in FIG. 4A. An exemplary UV sensor includes a Spectra GT10 Flame sensor manufactured by Ametek Power Instruments, but any suitable UV sensor may be used. UV sensor 4-66 may output a signal proportional to radical concentrations within the field of view of UV sensor 4-66, where radical concentrations may be used to determine the location of the homogeneous combustion wave. The field of view of UV sensor 4-66 is directed towards the outlet face of catalyst 4-10 to detect the radicals within the homogeneous combustion wave near the outlet face of catalyst 4-10. The position and view of UV sensor 4-66 may vary depending on the particular application. Additionally, multiple UV sensors may be used for redundancy or the like.

According to one exemplary method of detecting catalyst module overheating, the output of UV sensor 4-66 may be determined or detected over time to determine if catalyst 4-10 is overheating or there is a potential for overheating based on the relative location of the homogenous combustion wave to catalyst 4-10. If the derivative, i.e., rate of change, of the UV sensor 4-66 output over time is greater than a preselected minimum threshold value for given period of time the system may determine a temperature overheating event has or is likely to occur. In this example, the UV sensor 4-66 output is preferably monitored by a control system while the engine is operating at a substantially steady state mode, for example, while operating in speed or Exhaust Gas Temperature (EGT) control mode having a substantially uniform turbine speed of between approximately 95 and 105 percent of fill speed for single shaft gas turbine designs or greater than or equal to idle speed for two shaft gas turbine designs, and catalyst inlet temperature and catalyst outlet temperatures are substantially constant. Speed or EGT modes may include control strategies where fuel and/or air is varied based on predetermined fuel and/or air schedules associated with engine fundamentals such as the speed, EGT, delta EGT, turbine inlet temperature, compressor discharge pressure, compressor discharge temperature, and the like. During expected stable conditions, where engine speed is between approximately 99 and 101 percent for single shaft gas turbine designs but at a stable speed greater than or equal to idle speed for two shaft gas turbine designs, fluctuations or rapid increases in temperature may indicate an overheating event. In contrast, during engine acceleration or loading, the catalyst overheating detection methods may be unnecessarily triggered when such conditions, such as relatively high rates of change in the temperature, are more likely to arise. Therefore, during start up and shutdown, the rate of change of UV sensor 4-66 is not used to monitor overheating or potential overheating as described above.

The catalyst inlet temperature and catalyst outlet temperatures may be monitored by temperature probes, such as thermocouples 4-70 and 4-72. Each of the thermocouples represented as 4-70 and 4-72 may be a single thermocouple or may be a plurality of thermocouples distributed radially about the axis of the combustor. In one example, the temperature is considered constant if the temperature does not vary by more than a given amount, e.g., 10° C., over a given time period. The range and time period will depend on the system and application. Further, the threshold value may be determined or selected based on various factors associated with the catalyst module, the combustion system, the control system, and the like. Various other methods may be used to determine substantially constant catalyst inlet and catalyst outlet temperatures, and in some examples, may be assigned constant based on operating modes. Generally, by assuring that catalyst inlet and catalyst outlet temperatures are substantially constant, temperature excursions or high values of the catalyst module temperature or UV-sensor magnitude may be attributed to an overheating event.

According to another exemplary method, catalyst module overheating may be determined or detected if the magnitude of the UV sensor 4-66 output is greater than a minimum threshold value. In one example, overheating is detected if the magnitude exceeds a threshold value for given period of time. Similarly, the method is preferably performed when the engine is in a substantially steady-state speed, EGT, or similar control mode, and catalyst inlet temperature and catalyst outlet temperatures as measured by thermocouples are substantially constant. For example, the system is configured to determine that overheating of the catalyst module 4-10 has or may occur if the UV sensor 4-66 output is greater than 12 mA for 5 seconds, while the engine is in a substantially steady-state speed, EGT, or similar control mode and the measured catalyst inlet gas temperature does not vary by more than 10° C. over the same time period of 5 seconds, and the average of measured catalyst outlet gas temperature does not vary by more than 5 degrees in the preceding 40 seconds.

In another exemplary system, which may or may not include UV sensors 4-66, various temperature probes, e.g., thermocouples, may be disposed in combuster 4-26 to determine one or more of catalyst inlet temperature, catalyst outlet temperature, or interstage catalyst temperature (if applicable). Catalyst inlet gas temperature may be measured by thermocouples 4-72 located immediately upstream of the catalyst 4-9 inlet face. Thermocouples 4-72 may be disposed a suitable distance from the inlet face to accurately measure the inlet temperature, e.g., within 4 inches, and preferably within 2 inches of the catalyst module 4-9 inlet face. Catalyst interstage gas temperatures, i.e., the gas exiting the upstream stage catalyst 4-9 and entering the downstream stage catalyst 4-10, are measured by thermocouples 4-74 located in the axial space between the upstream and downstream catalyst stages 4-9, 4-10. Catalyst outlet gas temperatures are measured by thermocouples 4-70 located a suitable distance downstream of the catalyst 4-10 outlet face to measure the temperature accurately, e.g., within 4 inches and preferably within 2 inches of catalyst 4-10. It will be recognized by those skilled in the art that alternative temperature measurement devices and configurations may be used depending on various design configuration and applications. It will also be apparent that an exemplary system for performing the following methods may include one or more of the UV sensor 4-66, catalyst outlet thermocouples 4-70, catalyst inlet thermocouples 4-72, or catalyst interstage thermocouples 4-74. For example, multiple thermocouples may be arranged in various configurations circumferentially and radially around the inlet and/or exit face of the catalyst modules.

According to one exemplary method, catalyst module overheating may be determined or detected if the magnitude of the catalyst outlet face temperature as measured by a temperature probe, such as an Infrared (IR) thermal sensor 4-67, is greater than a preselected minimum threshold value for a give period of time, while the engine is in substantially steady-state speed, EGT, or similar control mode and catalyst inlet temperature remains substantially constant. For example, constant catalyst inlet temperature may be defined as that which does not vary by more than 10° C. over a determined time period.

According to one exemplary method, catalyst module overheating may be determined or detected if the derivative of one or more of the catalyst interstage temperature thermocouples 4-74, i.e., the rate of temperature change of one or more of the thermocouples 4-74, is greater than a preselected minimum threshold value for given period of time, while the engine is in substantially steady-state speed, EGT, or similar control mode, and catalyst inlet temperature remains substantially constant. For example, constant catalyst inlet temperature may be defined as that which does not vary by more than 10° C. over a determined time period.

In case of failure of a thermocouple or other instrumentation such as thermocouple drift or complete failure of a thermocouple to a high or low state, the system may include fault detection logic to ensure that instrumentation failure does not lead to erroneous engine shutdowns. In one example, where thermocouples are disposed in groups of three or more thermocouples, if any single thermocouple output deviates by more than 'X' degrees from the combined average, it is determined to be faulty. The value 'X' may be based on expected spreads from test results, operational history, or the like. In one instance 'X' is between about 10° F. and 150° F. In another example, having thermocouples disposed in groups of two or less, the thermocouple output is compared to a maximum and minimum threshold, based on, e.g., expected temperature ranges from test results or operational history. In one instance, ambient temperature thermocouple outputs are compared to a range of −40° C. and 60° C. If any single thermocouple output deviates beyond prescribed maximum and minimum thresholds, it is determined to be faulty. The maximum and minimum thresholds for each thermocouple can be based on manufacturer specifications particular to the thermocouple type. Typical values for N-type thermocouples are −50° F. to 2200° F. If a thermocouple is determined to be faulty, it may be no longer considered a valid measurement, and eliminated from further calculations, e.g., average, maximum, and minimum calculations.

Action taken based on thermocouple failures may differ based on the number of 'good' thermocouples present in the group (e.g., measuring temperature at the same station or location), and desired or necessity of redundancy of temperature readings for that particular station or location. In one example, if the difference between the total number of thermocouples in a group and the total number of thermocouples in that group that have failed is less than a given value, an engine shutdown will be initiated. The value where the engine is shutdown may be based on criticality of the measured parameter.

It should be recognized by those of ordinary skill in the art that other methods for determining and accounting for instrumentation failure, e.g., a thermocouple, are possible and contemplated.

According to another exemplary method, catalyst module overheating may be determined or detected if the magnitude of one or more catalyst interstage thermocouple 4-74 temperatures are greater than a preselected minimum threshold value for given period of time, while the engine is in a substantially steady-state speed, EGT, or similar control mode, and catalyst inlet temperature is substantially constant.

According to another exemplary method, catalyst module overheating may be determined or detected if the spread, e.g., the difference between the highest and lowest, of all catalyst interstage thermocouple 4-74 temperatures are greater than a minimum threshold value for given period of time, while the engine is in a substantially steady-state speed, EGT, or similar control mode, and catalyst inlet temperature is substantially constant.

According to another exemplary method, catalyst module overheating may be determined or detected if the derivative of one or more catalyst outlet temperature thermocouples 4-70, i.e., rate of temperature change, is greater than a minimum threshold value for given period of time, while the engine is in a substantially steady-state speed, EGT, or similar control mode, and catalyst inlet temperature is substantially constant.

According to another exemplary method, catalyst module overheating may be determined or detected if the magnitude of any one catalyst outlet temperature thermocouple is greater than minimum threshold value for given period of time, while the engine is in a substantially steady-state speed, EGT, or similar control mode, and catalyst inlet temperature is substantially constant. In this example, exceeding a minimum threshold value for one or more thermocouples may indicate that fuel is partially and locally igniting resulting in a high temperature region at the catalyst inlet which may cause, or potentially cause, catalyst overheating.

According to another exemplary method, catalyst module overheating may be determined or detected if the spread, e.g., the difference between the highest and lowest of all catalyst outlet temperature thermocouples is greater than minimum threshold value for given period of time, while the engine is in a substantially steady-state speed, EGT, or similar control mode, and catalyst inlet temperature is substantially constant.

According to another exemplary method, catalyst module overheating may be determined or detected by measuring the preburner (see FIG. 2) temperature rise. The preburner temperature rise is the difference between the preburner outlet temperature and the preburner inlet temperature. If the preburner temperature rise is greater than a preselected threshold value overheating of the catalyst may occur. For example, a threshold value may be determined by a schedule of allowable preburner temperature rises versus preburner fuel flows with the turbine speed greater than 95% full speed for single shaft gas turbine designs or greater than or equal to idle speed for two shaft gas turbine designs, and the turbine in a substantially steady-state speed, EGT, or similar control mode. In this example, a preburner temperature rise for a given fuel flow may be higher than expected due to fuel compositional changes, and such fuel compositional changes may lead to a catalyst overheating event.

According to another exemplary method, catalyst module overheating may be determined or detected by a composite model based function of temperatures and UV sensor output such as y=f(catalyst inlet, catalyst interstage, catalyst outlet, Tad, UV output), where y is compared to a threshold value to determine a potential or actual catalyst overheating event. If the model based output y is greater than a predetermined threshold value, overheating of the catalyst may occur. It should be recognized by those skilled in the art that various functions having various inputs may be used.

The preburner outlet temperature may be measured downstream of the preburner and the preburner inlet temperature may be measured upstream of the preburner by temperature probes such as thermocouples and the like. Alternatively, the catalyst inlet temperature may, be measured and the preburner outlet temperature calculated based on the fuel flow rate, fuel temperature, and air flow rate. These methods of detecting the preburner temperature are illustrative only and other methods of detecting the preburner temperature rise are possible.

In the various methods described above, the stable operating conditions include, for example, turbine speed greater than 95% full speed for single shaft gas turbine designs or greater than or equal to idle speed for two shaft gas turbine designs, and operating in a substantially steady-state speed, EGT, or similar control mode. In alternative control systems, any of the exemplary methods of overheating detection may be used with a reference to similar constant or stable control modes. The exemplary detection methods are preferably performed during constant or stable control modes to ensure detection of catalyst module overheating is not triggered when one expects such conditions to arise such as during engine acceleration or loading, for example, when temperature measurements may rise and fluctuate to a greater extent.

In another aspect of the present invention, different types of overheating may be detected. For example, catalyst module overheating may be classified under two general categories. The first includes local module overheating where a portion or section of the outlet face of the catalyst module exceeds a desired temperature limit. The second includes global module overheating where the entire outlet face of the catalyst module exceeds a desired temperature limit. Different control methods described herein may be better suited for particular local or global overheating detection. Additionally, various methods may be used alone or in combination with any other detection method to detect one or both of local and global catalyst overheating.

Various control strategies were carried out with a Kawasaki Heavy Industries M1A-13X gas turbine platform including a CESI Xonon™ Combustion System to detect both local module overheating and global module overheating of the catalyst 4-10. In one example, the exemplary method of measuring the output magnitude of UV sensor 4-66 as discussed above was carried out to detect local catalyst module overheating. In particular, local module overheating was determined if the UV sensor 4-66 output exceeded 12 mA for 5 seconds indicating the location of the combustion wave and the temperature near the catalyst module, while the engine operated in a substantially steady-state speed, EGT, or similar control mode, the catalyst inlet gas temperature did not vary by more than 10° C. over the same time period, and the average of catalyst outlet gas temperature did not vary by more than 5° C. in the preceding 40 seconds. It should be understood, however, that various other threshold values, temperatures, and time periods may be varied depending on the application, control strategy, desired results, and the like.

Further, in examples using the Kawasaki Heavy Industries M1A-13X gas turbine platform, global module overheating was detected by the exemplary method of measuring the catalyst outlet temperature magnitude against a threshold limit. For example, global module overheating was detected if the magnitude of the output of any one catalyst outlet thermocouple 4-70 exceeded 910° C. for 5 seconds, while the engine operates in a substantially steady-state speed, EGT, or similar control mode, and catalyst inlet temperature did not vary by more than 10° C. over 40 seconds. The threshold value of the catalyst outlet thermocouple 4-70, in this example of 910° C., may be increased or decreased based on the age or usage of the catalyst module, e.g., a relatively new or fresh catalyst module where catalytic activity is at its highest may include a higher threshold value of, e.g., 935° C. Again, it should be understood, however, that various other threshold values, temperatures, and time periods may be varied depending on the application, control strategies, desired results, and the like.

It should be recognized that various other configurations of UV sensors and/or temperature probes may be used to detect catalyst module overheating, including local and global overheating. Further, the various methods described herein may be used alone or in combination with other control and detection methods.

Figure 4B:
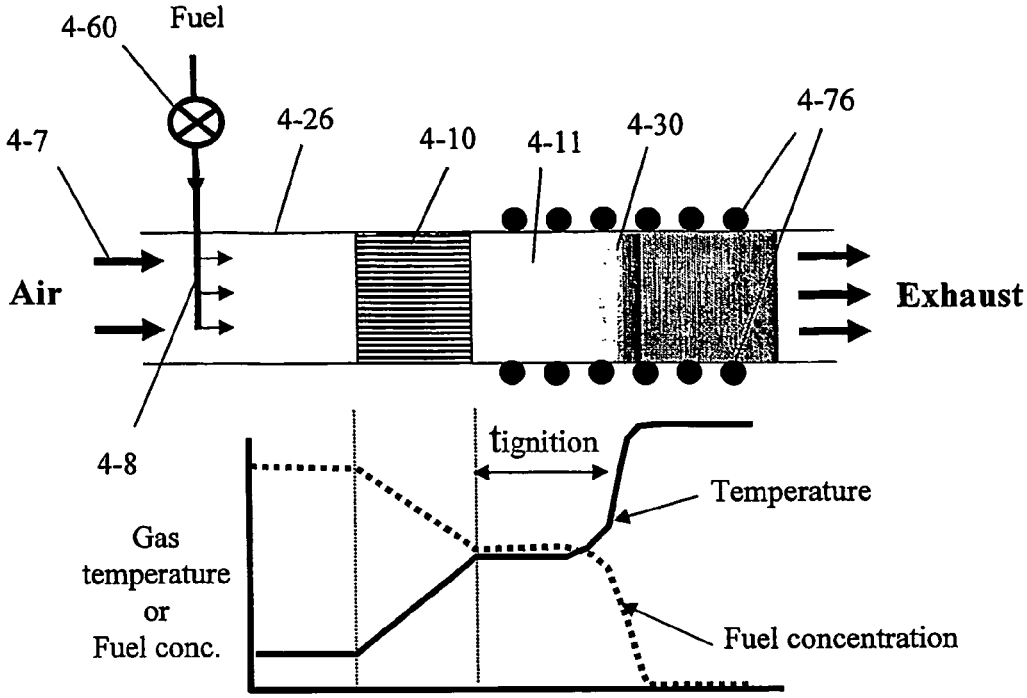

According to another exemplary method illustrated in FIG. 4B, catalyst module overheating may be determined or detected by measuring the homogenous combustion wave front location with respect to the catalyst. FIG. 4B is similar to FIG. 4A, however, a single stage catalyst 4-10 design is shown to simplify the description. In this example, thermocouples 4-76 arranged axially and disposed either in the flowpath to measure gas temperatures or metal temperatures on the homogeneous combustion wave burn-out zone liner (as shown), may provide an indication of location of the homogeneous combustion wave 4-30. The location of the homogeneous combustion wave 4-30 may be determined based on an increase in temperature as shown in the graph below combustor 4-26. As an example, when thermocouples 4-76 at particular location 'X' with respect to the catalyst 4-10 outlet face detect or measure temperatures greater than a value 'Y,' overheating conditions are determined. The thermocouple 4-76 location 'X' may be based on a safe distance necessary for control system response, and the temperature value 'Y' based on Tad. In one example, the thermocouple location 'X' is 12 inches from the catalyst outlet face, and the temperature value 'Y' is 1000° C. Although a plurality of thermocouples 4-76 are illustrated, a single thermocouple 4-76 could be used.

Figure 4C:
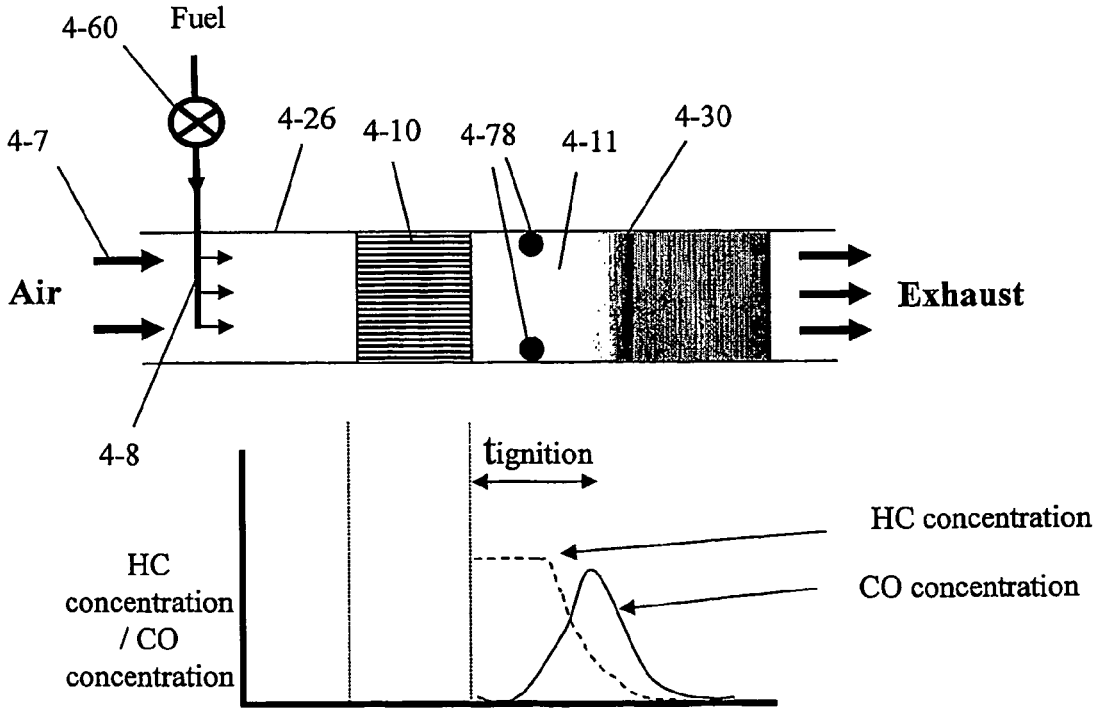

According to another exemplary method illustrated in FIG. 4C, catalyst module overheating may be determined or detected by measuring the homogenous combustion wave 4-30 location with respect to the catalyst 4-10 with at least one gas emissions analyzer port 4-78. When emissions analyzer port(s) 4-78 at location 'X' indicate hydrocarbon and/or CO content less than 'Z' ppm, overheating conditions are detected. The graph shown below combustor 4-26 illustrates generally the levels of hydrocarbon (HC) and CO concentrations relative to the homogeneous combustion wave location 4-30. The value 'X' is similar to that discussed with regard to FIG. 4B, and the value 'Z' may be based on hydrocarbon and/or CO content after almost complete combustion. In one example, 'X' is 12 inches, and 'Z' is 50 ppm. Additionally, because the exemplary catalyst overheating detection methods are generally used for substantially steady state conditions, time delay associated with the sampling may be permissible.

Catalyst Module Overheating Response Strategies:

According to another aspect of the present invention, methods for responding to possible or actual catalyst module overheating conditions are provided. Generally, the exemplary methods and strategies can be categorized as methods predominantly resulting in a reduction in catalyst inlet fuel-air ratio, and strategies predominantly resulting in a reduction in catalyst inlet temperature.

The air management system of the combustor system, including, for example, bypass, bleed, and/or compressor inlet guide vanes as described below, may be utilized to increase catalyst air flow and thereby reduce the catalyst inlet fuel-to-air ratio. Reducing the catalyst inlet fuel-to-air ratio may reduce the temperature of the catalyst module and prevent or reduce catalyst over heating. Reducing catalyst fuel flow may also reduce the fuel-to-air ratio. Additionally, reducing the preburner outlet temperature and/or reducing catalyst fuel temperature may reduce catalyst inlet temperature. Other suitable methods for varying the fuel-to-air ratio or catalyst inlet temperature may be used. Specific strategies employed may be specific to the system and its operating cycle conditions.

Figure 5:
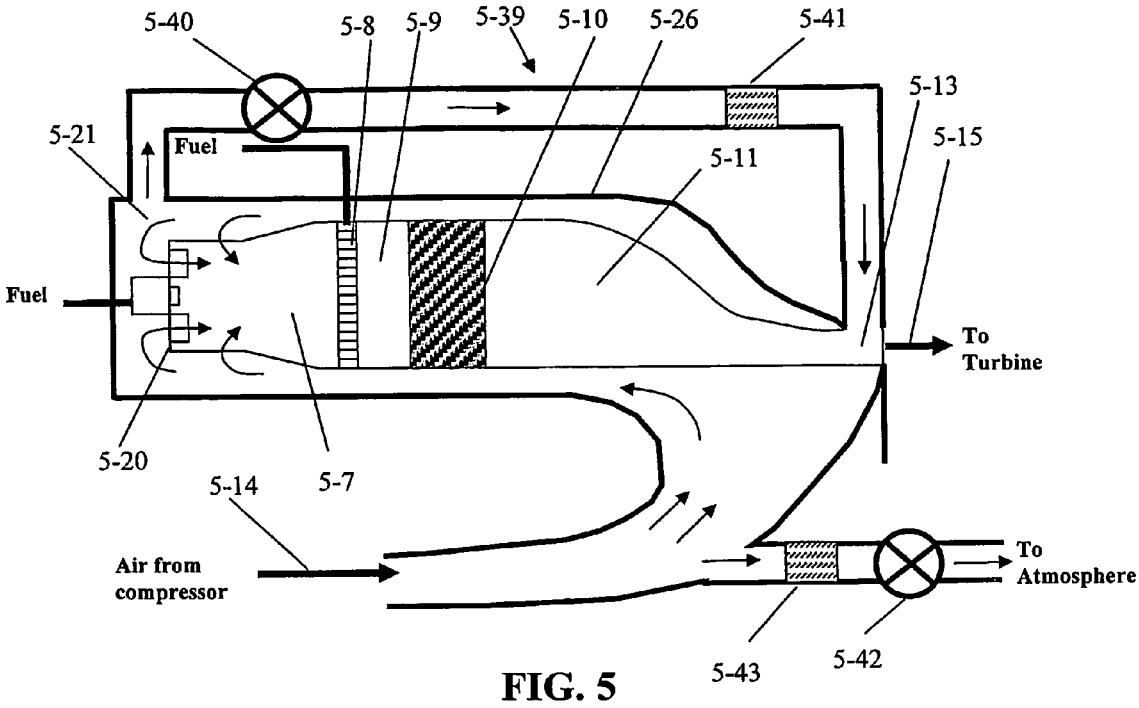
FIG. 5 illustrates an exemplary catalytic combustion system with a bypass valve and a bleed valve.

An exemplary bypass system that may be controlled to vary the catalyst air flow and fuel-to-air ratio is illustrated in FIG. 5. The bypass system 5-39 extracts air from a region 5-21 near the inlet of preburner 5-20 and injects the air in a region 5-13 downstream of the post catalyst reaction zone 5-11 but upstream of the power turbine inlet 5-15. Bypass air can also be extracted at the outlet of the compressor, at any location between the compressor outlet and the preburner 5-21, or downstream of the preburner 5-20 and before the inlet to the catalyst 5-10. Flow meter 5-41 may measure the bypass airflow and valve 5-40 may control the bypass airflow. The bypass flow from region 5-21 to region 5-13 is driven by the pressure difference with region 5-13 at a lower pressure than region 5-21. This pressure difference is due to the pressure drop that occurs through the combustor including the preburner 5-20, the catalyst fuel injection and mixing system 5-8, and the catalyst 5-10. The bypass system 5-39 allows for the control of the air flow entering the catalyst by controlling the combustor airflow. The bypass system 5-39 may thereby influence the temperature of the catalyst module as well as control the homogeneous combustion wave in the burnout zone 5-11 of combustor 5-26.

FIG. 5 also illustrates an exemplary bleed system that may be used alone or in combination with bypass system 5-39 for controlling the airflow of combustor 5-26. The bleed system extracts air from a region near the compressor discharge 5-14 and vents it to the atmosphere. A flow meter 5-43 may measure the flow of bleed air and valve 5-42 may control flow of bleed air. The bleed flow from 5-14 to atmosphere is driven by a pressure difference with 5-14 being higher pressure than atmospheric pressure.

Exemplary combustors may also include inlet guide vanes (not shown) to vary the amount of airflow through the engine and combustor. Inlet guide vanes generally include a set of vanes disposed at the inlet of the compressor that may be selectively rotated to vary the airflow into the compressor and therefore the total airflow through the system. The inlet guide vanes may be used to reduce (or increase) airflow and increase (or decrease) the fuel-to-air ratio within the combustor to stay within a desired operating range.

One exemplary method for responding to actual or potential catalyst module overheating includes closing the bypass valve 5-40, which is generally at least partially open during operation. Closure of the bypass valve 5-40 is induced by a reduction in adiabatic combustion temperature demand (Tad) and results in a decrease in the catalyst inlet fuel-to-air ratio. It will be understood by those of ordinary skill in the art that alternate methods of closing the bypass valves may be implemented and would depend on how the process variable used for the bypass valve control is related. The bypass valve 5-40 may be closed partially, followed by a waiting period to determine if the reduction has reduced or eliminated the catalyst 5-10 overheating. For example, the output from a dEGT versus Tad demand value may be temporarily reduced by a predetermined percentage ranging from 0.1 to 10%. DEGT may be used to specify operation at a preferred point on an operating line of the system. DEGT at time t is defined as the calculated exhaust gas temperature at full load at time t ($EGT_{full\ load\text{-}t}$) minus the exhaust gas temperature value at time t ($EGT_t$) and expressed as follows:

$$dEGT=EGT_{full\ load\text{-}t}-EGT_t$$

The exhaust gas temperature at full load ($EGT_{full\ load\text{-}t}$) may be calculated from current operating parameters such as ambient temperature and ambient pressure at any time t and represents the expected exhaust gas temperature when the turbine is running at full load (100% load). The current exhaust gas temperature ($EGT_t$) is the measured value of the exhaust gas temperature at any time t. Subtraction of these values gives the DEGT at time t.

If the overheating has subsided after reducing the DEGT versus Tad demand value bypass valve 5-40 may return to its previous operating setting or range. If the overheating has not subsided, the bypass valve 5-40 may be closed further followed by further monitoring. Incremental reductions in Tad demand may be made until the bypass valve 5-40 is fully closed or the overheating has subsided.

Referring to Table A below, there are, for example, three schedules of dEGT versus Tad demand and demand temperature at location 5-7, referred to herein as T34 (see also FIG. 2), for three different levels of catalyst activity (1, 2 or 3).

TABLE A

| Operating Schedules | | | | | | | |
|---|---|---|---|---|---|---|---|
| | dEGT vs. Tad and T34 schedules | | | | | | |
| % Load | dEGT (° C.) | Tad Demand 1 (° C.) | T34 Demand 1 (° C.) | Tad Demand 2 (° C.) | T34 Demand 2 (° C.) | Tad Demand 3 (° C.) | T34 Demand 3 (° C.) |
| 100 | 0 | 1300 | 500 | 1310 | 505 | 1320 | 510 |
| 90 | 35 | 1275 | 505 | 1285 | 510 | 1295 | 515 |
| 80 | 70 | 1250 | 510 | 1260 | 515 | 1270 | 520 |
| 70 | 105 | 1225 | 520 | 1235 | 525 | 1245 | 530 |
| 60 | 140 | 1200 | 530 | 1210 | 535 | 1220 | 540 |
| 50 | 175 | 1175 | 555 | 1185 | 560 | 1195 | 565 |
| 40 | 210 | 1150 | 580 | 1160 | 585 | 1170 | 590 |
| 30 | 245 | 1125 | 605 | 1135 | 610 | 1145 | 615 |
| 20 | 280 | 1100 | 650 | 1110 | 650 | 1120 | 650 |
| 10 | 315 | 1075 | 650 | 1085 | 650 | 1095 | 650 |
| FSNL | 350 | 1050 | 650 | 1060 | 650 | 1070 | 650 |

Another exemplary method for responding to catalyst module overheating includes varying the air flow through the system with a bleed valve 5-42. The methods may be carried out similar to the bypass valve 5-40 methods described above.

Another exemplary method for responding to catalyst module overheating includes decreasing the catalyst inlet temperature by reducing the preburner fuel flow. With reference again to FIG. 2, reduction in preburner fuel flow 2-24, which may be induced by a reduction in preburner outlet gas temperature demand, results in a decrease in preburner outlet temperature, referred to herein as "T34," and catalyst inlet temperature, referred to herein as Another exemplary method for responding to catalyst module overheating includes reducing catalyst fuel flow. Reduction of catalyst fuel flow 2-25, which may be induced by a reduction in engine load demand, results in a decrease in catalyst inlet fuel-to-air ratio and catalyst outlet temperature T37. Reductions of catalyst fuel flow 2-25 may be made incrementally, followed by periods of monitoring, as described above. It should be recognized, that there are numerous methods for reducing fuel flow, e.g., acting on a fuel valve directly, varying a signal controlling fuel flow, and the like.

Additional control strategies can be developed to achieve similar results. Those of ordinary skill in the art of controls, control systems and/or catalytic combustion control algorithms can develop alternative and equivalent approaches to bypass valve closure, reduction in preburner fuel flow, and decrease in catalyst inlet fuel flow to result in lower catalyst inlet temperatures and fuel-to-air ratios based on their knowledge and the disclosure herein.

The exemplary methods may be performed alone or in any combination. In one example, illustrated in FIG. 6, several exemplary methods described above are performed in a predetermined series until the catalyst overheating, or potential of overheating, is reduced. In a first response approach, upon detection of potential or actual catalyst overheating conditions in block 6-1, the control system may respond by reducing the bypass air flow in block 6-2. This is incorporated by taking the output from a DEGT versus Tad demand value and temporarily reducing the demand value by a predetermined percentage that may range from 0.1 to 10%, and preferably 1 to 2%. For example, if the predetermined percentage is 1.5% and the Tad demand value is 1340° C., the temporarily reduced value is $$1340-(1340*1.5\%)=1319.9° C.$$

If the first reduction in Tad demand eliminates the detected overheating, then this temporary reduction may be held for a predetermined fixed duration, e.g., 55 seconds, after which the Tad demand returns to its original set-point. However, if the first reduction is not successful in eliminating the detected overheating, Tad demand is reduced by an additional percentage, 1.5% in this example; however, the percentage may vary for each incremental decrease. This series of incremental percentage reductions continue until the Tad cannot be reduced further because the bypass is fully closed, after which a second response approach may be activated.

In a second response approach to the catalyst module overheating conditions, the control system may respond by reducing the preburner fuel flow in block 6-3. This is incorporated by taking the output from a dEGT versus T34 demand value and temporarily reducing it by a predetermined percentage that ranges from 0.1 to 10%, and preferably between 1 and 2%. For example, if the predetermined percentage was 1.5% and the T34 demand value is 510° C., the temporarily reduced value is:

$$510-(510*1.5\%)=502.4° C.$$

If the first reduction in T34 demand eliminates the detected overheating, then this temporary reduction is held for a predetermined fixed duration, e.g., 55 seconds, after which the T34 and Tad demands return to their original set-points. However, if the first reduction is not successful in eliminating the detected overheating, T34 demand may be reduced again, e.g., by another 1.5%. This may continue until the preburner fuel flow is at its minimum level to sustain flame, after which a third response approach may be activated if needed.

In a third response approach to the catalyst module overheating conditions, the control system may respond by reducing the engine fuel flow demand in block 6-4. This is incorporated by taking the Generator Load set point, e.g., the desired output of a power plant or the like, and ramping it down 25 kW (e.g., past the point where the Generator Load set point crosses over the Generator Load feedback). If the first reduction in Generator Load set-point eliminates the overheat detection, then this temporary reduction is held for a predetermined fixed duration, e.g., 55 seconds, after which the Generator Load, T34, and Tad return to their original set-points. However, if the first reduction is not successful in eliminating the overheating conditions, Generator Load set-point is reduced by an additional 25 kW. This series of reductions and pauses may continue until load is dropped to a level, e.g., below an emission guarantee range, upon which time the engine may automatically unload and shut-down.

During application of the above strategies it was noted that the release (when set-points return to normal) of the first, second, and third approaches sometimes resulted in an overshoot in fuel-to-air ratio, which in itself triggered additional catalyst module overheating events. To compensate for this occurrence an additional strategy may be incorporated. For every three overheating responses, the operating schedule may be decreased by one (see Table A, e.g., reducing from schedule 3 to 2, or from schedule 2 to 1). Although this caused the catalytic combustion system to operate temporarily under cooler conditions, steady-state catalyst exit gas temperature feedback based adaptive control logic may increase the operating schedule back to its original value over time. Such exemplary control methods and systems for catalytic combustion systems, including a bypass valve and/or bleed valve system, are described in U.S. patent application Ser. Nos. 10/071,749 and 60/440,940, which are incorporated herein by reference in their entirety.

Figure 6:
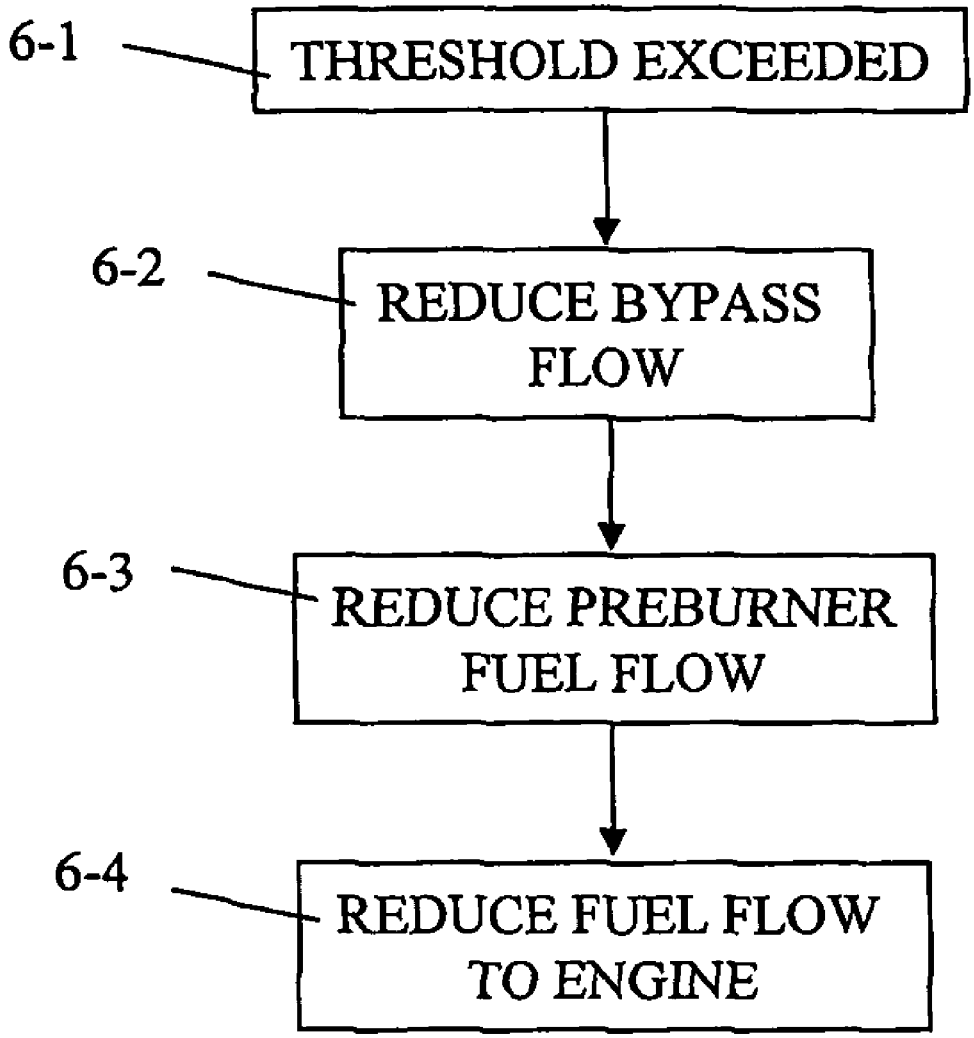
FIG. 6 illustrates an exemplary response strategy to catalyst overheating.

It should be understood that the exemplary method of FIG. 6 is exemplary only and the various responses in blocks 6-2 through 6-4 may be carried out in any order as well as in parallel. Also, additional methods to reduce catalyst module overheating, e.g., including a bleed valve or inlet guide vanes to vary airflow and air-to-fuel ratios, may also be included and carried out in series or parallel.

Control Strategies During Transient Operations:

According to another aspect of the present invention, methods and systems are provided for reducing or eliminating overshoots in the catalyst outlet gas temperature T37 beyond desired threshold temperatures. Overshoots in the catalyst outlet gas temperature may cause damage to the catalyst module or combustion system. Catalyst outlet gas temperature overshoots occur primarily during transient modes of the system, such as during load ramps, engine accelerations, startups, and the like. Temperature overshoots are generally caused by overshoots in the fuel-to-air ratio resulting from either overshoots in the fuel and/or lagging response of the air management system, e.g., including a bypass valve control system, a bleed valve control system, and an inlet guide vane control system. It should be recognized that other factors may contribute to or cause temperature overshoots directly or indirectly and may be reduced by exemplary methods described herein.

Generally, a catalytic combustion system includes a predetermined temperature or trip limit relating to the catalyst outlet gas temperature T37 to prevent damage to the combustor and turbine components due to undesirably high temperatures. Transient overshoots may put the T37 temperature values above the trip limit, resulting in engine shutdowns to reduce the potential for damage. Therefore, reducing the potential for temperature overshoots reduces the potential for temperature related damage to the catalyst module and combustion system as well as reducing unanticipated engine shutdowns.

In one example, reducing the effective load ramp rate may reduce transient overshoots. This would impact the rate at which the dEGT is changed to meet the desired generator load setpoint is achieved. The effective load ramp rate may be reduced using two methods and may be used alone or in combination: (a) uniform reduction in load ramp rate demand, or (b) incremental load ramp steps followed by pauses (when intermediate generator load setpoint is held constant), until the final generator load setpoint is achieved. Depending on the particular system and application, load ranges, ramp rates, and pause times may be chosen to reduce the potential for overshoots of the catalyst outlet gas temperature. Other engine fundamental quantities associated with engine load such as EGT, ambient temperature, compressor discharge pressure, compressor discharge temperature, and the like may be substituted for DEGT.

In another example, transient overshoots may be reduced by the reduction of T37 prior to the execution of load ramp operations (pre-ramp T37). For example, a reduction in fuel or an increase in air through the catalyst module prior to a load ramp operation may decrease the potential for an overshoot of T37 during or subsequent to the load ramp. Generally, air is increased while fuel remains constant to maintain generator output. In one example, both fuel and air are reduced but fuel is reduced more than air such that the net fuel air ratio in the catalyst is decreased.

Alternatively, catalyst inlet temperature T36 may be reduced by a reduction in T34 demand, which may decrease the potential for an overshoot of T37 during or subsequent to the load ramp.

In another example, transient overshoots may be reduced through T37 limit feedback control, where the effective load ramp rate is limited at least partially on pre-established T37 upper and lower limits of the system. When T37 reaches the upper limit during a load ramp, the load ramp pauses until T37 drops below the lower limit, at which time the ramp continues to increase until the final load set-point or upper load limit is reached.

The exemplary methods described above may be employed alone or in any combination to reduce the potential for overshoots in T37. In one example, reducing T37 prior to execution of load ramps may be used in conjunction with reducing the load rate. The combination of both methods may be more effective than either method alone. Other similar and equivalent strategies apparent to those of ordinary skill in the art and may be used with the exemplary methods described.

Figure 7:
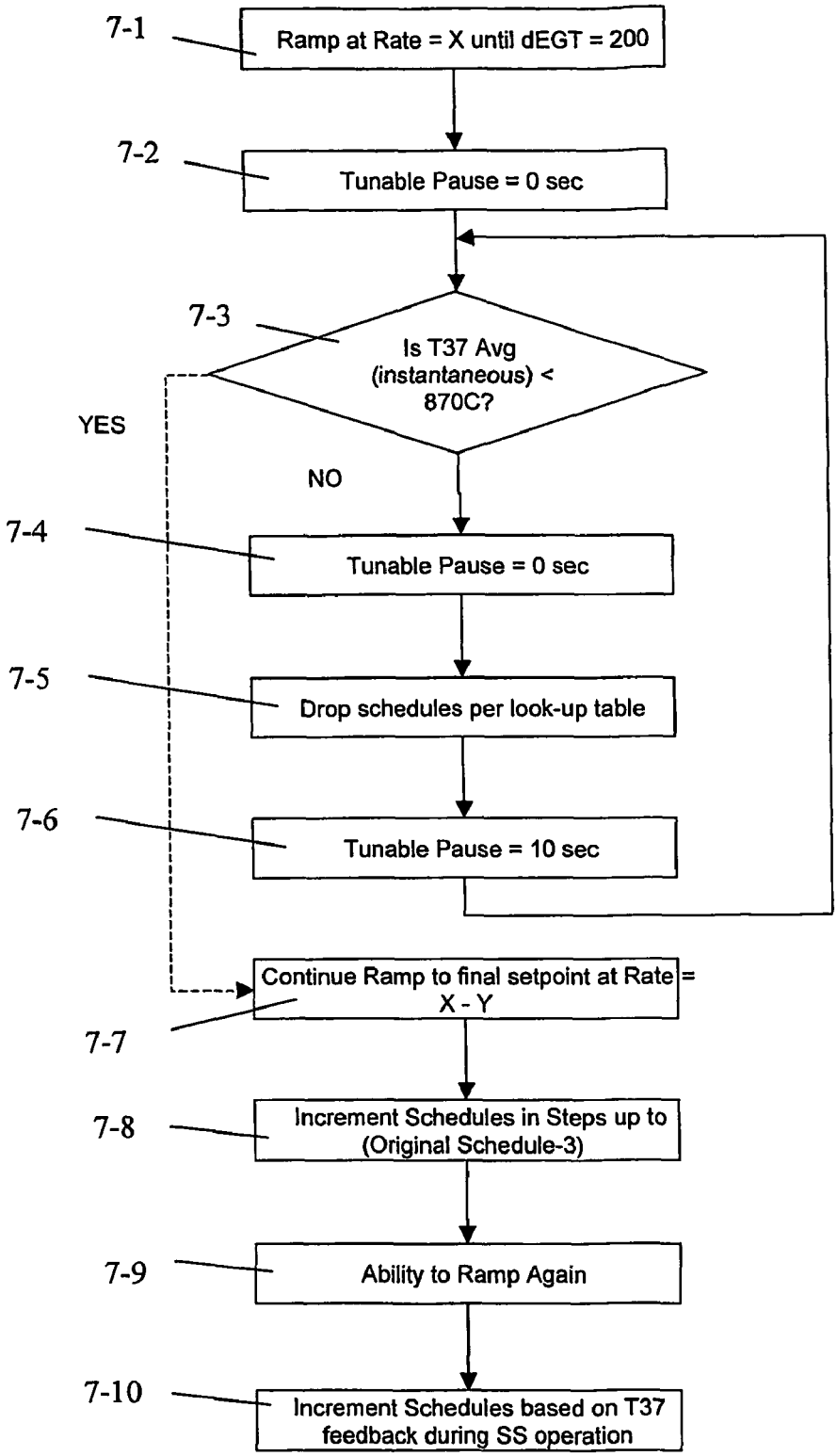
FIG. 7 illustrates an exemplary control method for a load ramp in a single or multiple combustor system.

FIG. 7 illustrates an exemplary control strategy for reducing the potential for overshoots in the catalyst outlet gas temperature during transient operations such as load ramps and the like. An exemplary control strategy was implemented on a Kawasaki Heavy Industries (KHI) M1A-13X gas turbine engine equipped with a CESI Xonon™ Combustion System. As will be recognized by those of skill in the art, other similar or non-similar gas turbine systems may also be used with the exemplary control strategies.

In block 7-1, the system is initially controlled at a ramp rate X until DEGT reaches 200° C., where ramp rate X represents the default ramp rate for the particular application. In one example the ramp rate was set to 25 kW/sec. The DEGT threshold value may be preselected and based at least in part on test results. In one example, several tests were conducted to determine a load range in which the transient T37 peaks exceeded set limits for the particular system. Testing revealed that the T37 overshoots were most intense and had the highest propensity to exceed preset limits in the range of 70% to 100% of the full load. In this example, dEGT=200 corresponds to approximately 70% load such that the engine is ramped to the lower end of the range where overshoots are likely to occur for the particular system at the default ramp rate. It should be recognized that various other engine fundamental quantities similar to engine load can be substituted for DEGT. Further, the value of DEGT may vary depending on the particular application and system.

The exemplary method may include a tunable pause in block 7-2 to allow the system to respond to the ramp rate. In this particular example the tunable pause was set at 0 seconds because the system response was adequate without such a pause. In alternative applications and systems, however, a tunable pause may be useful and desired.

In block 7-3, the control strategy determines if the catalyst exit temperature T37 is less than a predetermined threshold temperature. In this example an average temperature T37 is measured where the temperature is the instantaneous average of all T37 thermocouple outputs. In this example, the threshold temperature was selected at 870° C. The threshold value may be chosen, at least on part, on minimizing the T37 overshoots during ramps, and minimizing delay time caused by operating in the loop from block 7-3 to block 7-6 and back to block 7-3 (as shown in FIG. 7 and described below). Further, the threshold value may vary depending on the particular system and application and may be greater for a catalyst module in its initial use when catalyst activity is generally at its highest. In this example, testing showed that the threshold value may be increased to approximately 880° C. for a catalyst module during its first 500 hours of operation. The comparison of T37 average to the threshold value results in the control strategy flowing either to block 7-7 if the average temperature of T37 is less than a predetermined threshold, or to block 7-4 if the average temperature of T37 is greater than the predetermined threshold.

In block 7-4, another tunable pause may be performed to allow the system to respond. In this example, the tunable pause was again set at 0 seconds; however, in other applications and system configurations a tunable pause of varying lengths may be useful and desired.

In block 7-5, the operating schedule is dropped per a look-up table, e.g., Table B shown below, where Table A above includes exemplary operating schedules. Schedule decrements may be used as a method to reduce pre-ramp T37. In an effort to minimize delay time caused by operating in the loop from block 7-3 to block 7-6 and back to block 7-3 (as shown in FIG. 7), a look-up table that will drop schedules based on the deviation of T37 average from the set-point in block 7-3 may be used. An example of this look-up table is shown in Table B.

TABLE B

Schedule Decrement Look-up Table:

| T37 Avg Instantaneous Range (° C.) | Number of schedules to decrement |
|---|---|
| 860-870 | 1 |
| 870-880 | 2 |
| 880-890 | 3 |
| >890 | 3 |

In block 7-6 an additional tunable pause may take place to allow the system to respond to the schedule decrement. In this example, a tunable pause of 10 seconds is performed. The tunable pause may allow the combustion system to respond to the schedule drop in block 7-5, and to register a drop in T37 average. The length of tunable pause in block 7-6 may vary depending on the particular system and application.

Returning to block 7-3, if T37 is less than the predetermined threshold, e.g., 870° C., the system ramps to the final set-point at a rate equal to X−Y in block 7-7, where Y may be set between 0 and the value of X to reduce the ramp rate. In this example, X=25 kW/sec, and Y=0 kW/sec. Increasing Y above 0 allows incorporation of a reduced ramp rate if desired. Both X and Y will vary depending on the particular system and application.

In block 7-8 schedules may be incremented up, for example, to the original schedule, i.e., the original schedule number prior to ramping load in block 7-3. Schedules may be incremented, e.g., one at a time, with a delay of 5 seconds after each increment, and a comparison with a T37 threshold=865° C. before performing each increment. This T37 threshold was chosen based on minimizing CO emissions of the particular system, however, other increments, delay times, and thresholds, are contemplated. The original schedule (in block 7-3) may be chosen based at least in part on minimizing the time spent at a schedule lower than the original schedule in order to minimize CO emissions, and minimizing the time before the controls logic can allow load to be ramped again.

In block 7-9 the control strategy may ramp again if desired. In one example, the control logic may allow load to ramp again only if T37 exceeds a minimum set-point. In the present example, the minimum set-point is 865° C.

When steady state operation is reached in block 7-10, the schedules may be incremented or decremented based on T37 feedback. For example, adaptive control logic may use T37 average feedback to increment schedules as desired during steady state operation. It should be understood that the method of FIG. 7 is exemplary only. Additional methods to reduce potential overshoots may also be included and carried out in series or parallel.

Exemplary control methods and systems for carrying out the various control methods are described in U.S. patent application Ser. Nos. 10/071,749 and 60/440,940, which are incorporated herein by reference in their entirety. Further, it should be understood that the above described methods and control systems throughout this detailed description may be performed by hardware, software, firmware, or combinations thereof.

The above detailed description is provided to illustrate exemplary embodiments and is not intended to be limiting. It will be apparent to those skilled in the art that numerous modification and variations within the scope of the present invention are possible. Accordingly, the present invention is defined by the appended claims and should not be limited by the description herein.

We claim:

1. A method for detecting catalyst module overheating in a catalytic combustion system comprising the acts of:

detecting one or more signals from at least one probe adapted to obtain values associated with at least one of an outlet gas temperature of a catalyst and an outlet face temperature of the catalyst included in a catalytic combustor;

comparing the one or more signals with a value associated with catalyst overheating; and determining an inlet temperature of the catalyst, wherein the catalyst inlet temperature is substantially constant when determining the temperature associated with at least one of the outlet gas temperature of the catalyst and the outlet face temperature of the catalyst.

2. The method of claim 1, wherein detecting the one or more signals includes detecting at least one of an average temperature and maximum temperature.

3. The method of claim 1, wherein the one or more signals are detected over a period of time.

4. The method of claim 1, wherein detecting the one or more signals includes detecting a rate of change in the temperature.

5. The method of claim 1, wherein detecting the one or more signals includes determining at least one of an average temperature and maximum temperature associated with multiple temperature probes.

6. The method of claim 1, wherein the one or more signals are detected during a turbine speed approximately 95% or greater of full speed for a single shaft gas turbine.

7. The method of claim 1, wherein the one or more signals are detected during a turbine speed greater than or equal to idle speed for a two shaft gas turbine.

8. The method of claim 1, wherein the one or more signals are detected during a substantially stable control mode.

9. The method of claim 1, wherein detecting the one or more signals includes infrared thermal sensor with a field of view directed to an outlet face of the catalyst.

10. The method of claim 1, wherein detecting the one or more signals includes one or more temperature probes located downstream of the catalyst.

11. The method of claim 1, wherein detecting the one or more signals includes one or more temperature probes located upstream of the catalyst.

12. The method of claim 1, further including determining an interstage gas temperature between the catalyst and a second catalyst located serially in the catalytic combustor.

13. The method of claim 1, further including at least a second catalytic combustor arranged in a multi-combustor configuration.

* * * * *